United States Patent [19]

Purcell et al.

[11] Patent Number: 4,639,638

[45] Date of Patent: Jan. 27, 1987

[54] PHOTOMULTIPLIER DYNODE COATING MATERIALS AND PROCESS

[75] Inventors: John A. Purcell, Hightstown; John T. Puglis, Bridgewater; Steven W. Duckett, Princeton, all of N.J.

[73] Assignee: Sangamo Weston, Inc., Norcross, Ga.

[21] Appl. No.: 695,155

[22] Filed: Jan. 28, 1985

[51] Int. Cl.[4] ..... H01J 1/32; H01J 43/22

[52] U.S. Cl. ..... 313/534; 313/535; 313/539; 313/106; 427/77

[58] Field of Search ..... 313/527, 532, 533, 104, 313/105 R, 630, 103 CM, 534, 535, 539, 106, 107; 427/74, 77

[56] References Cited

U.S. PATENT DOCUMENTS 2,123,024 7/1938 Piore et al. ..... 313/532 X 3,710,125 1/1973 Jacobs et al. ..... 313/532 X

*Primary Examiner*—Palmer C. DeMeo

*Assistant Examiner*—K. Wieder

*Attorney, Agent, or Firm*—Dale Gaudier

[57] ABSTRACT

The photosensitivity of a photomultiplier dynode to white light or infrared radiation is greatly reduced by coating the dynode with a layer of an alkali halide material having good secondary electron emission characteristics. A method of applying the coating to the dynode is also described.

18 Claims, 6 Drawing Figures

PHOTOMULTIPLIER DYNODE COATING MATERIALS AND PROCESS

BACKGROUND OF THE INVENTION

1. Field of the Invention

The present invention relates to the field of photomultipliers and, more particularly, to a coating material and method for reducing the photosensitivity of electron accelerating structures, such as dynodes, to visible and infrared radiation.

2. Description of the Prior Art

Photomultipliers come in a wide variety of forms and generally include a photocathode formed from a material exhibiting photoemissivity, i.e. photons impinging on the material cause electrons to be ejected from the photoemissive material. Various electron accelerating structures, such as focus electrodes and dynodes, are spaced apart from the photocathode. A DC potential is applied to the photocathode, focusing electrodes and dynode with the dynode being made positive with respect to the photocathode so as to attract any electrons ejected from the surface of the photocathode. The electrical potential between the acceleration structures and the photocathode acts to accelerate the photoelectrons ejected from the photocathode toward the dynode. This causes the photoelectrons which impact and collect on the dynode to have a higher energy than when they were initially ejected from the photocathode. The dynode is usually coated with a material, such as beryllium oxide, which exhibits good secondary electron emission: i.e. a primary electron which impacts the surface of the dynode will cause one or more secondary electrons to be emitted from the secondary emissive material coating the dynode.

These secondary electrons may be further accelerated by placing a second dynode a short distance away from the first dynode and applying a DC potential to the second dynode which is positive with respect to the first dynode. The secondary electrons are therefore accelerated toward the second dynode, which is similar in structure to the first dynode. This dynode structure may be repeated for as many stages as desired. The final stage of the photomultiplier is an anode which is made more positive with respect to the last dynode and which serves to collect the secondary electrons being emitted by the last dynode stage.

Since each secondary electron which is ejected from a dynode caused one or more secondary electrons to be ejected from the succeeding dynode, a cascade effect will occur: a single incident photoelectron collected by the first dynode results in several thousands or millions of secondary electrons being collected at the final stage (the anode) of the photomultiplier.

Although the foregoing is descriptive of the general structure of a photomultiplier, it will be appreciated that photomultipliers come in other forms. Thus, the dynodes may be separate structures, or as in the case of a microchannel plate photomultiplier, the dynode is a continuous tubular structure having an electron emissive material coated on its interior. Examples of common types of photomultiplier structures are shown in *Photomultiplier Handbook*, RCA, 1980, pages 26–35.

Photomultipliers are usually designed for use in specific applications and for detecting photons of a particular range of energies or wavelengths. The particular photocathode materials used will therefore depend upon the particular energies or wavelengths of interest.

One such type of photomultiplier is the so-called "solar blind" photomultiplier which is sensitive to photons in the ultraviolet spectrum. It is desirable that a UV sensitive photomultiplier exhibit little or no response to photons of energies corresponding to wavelengths greater than 350–380 nanometers, i.e. radiation in the visible and infrared spectrum, since this radiation tends to "swamp out" the shorter wavelength UV radiation.

There are many materials which are sensitive to ultraviolet radiation. Such materials include cuprous chloride, sodium chloride, potassium bromide, copper iodide, cesium iodide, cesium telluride, rubidium iodide, rubidium telluride and potassium telluride. The particular material selected will depend upon the portion of the ultraviolet spectrum which is of interest.

For example, cesium telluride ($Cs_2Te$) has a quantum efficiency (number of photoelectrons ejected per incident photon) percentage of greater than 2% at wavelengths between approximately 105–300 nanometers. Another common UV sensitive photocathode material is rubidium telluride ($Rb_2Te$) which has a quantum efficiency of greater than 2% at wavelengths between approximately 150–290 nanometers.

One problem associated with solar blind photomultipliers is that the alkali metals commonly used in the processing of the photocathode (e.g. cesium, rubidium or potassium) are applied using a gaseous diffusion process. This results in some excess alkali metal being deposited not only on the photocathode but also on the dynodes or other electron accelerating structures, such as the focusing electrodes. This free alkali metal is itself photoemissive and sensitive to photons having energies corresponding to wavelengths in the visible and infrared regions. Since the UV sensitive photocathode materials used in making a solar blind photomultiplier are generally semi-transparent, any visible or infrared radiation impinging on the photomultiplier will strike the dynodes and cause an unwanted response in the output of the photomultiplier.

Due to the nature of the diffusion process used in applying the photosensitive alkali metal components to the photocathode, it is not possible to completely eliminate or remove the free alkali metal from unwanted areas within the photomultiplier.

SUMMARY OF THE INVENTION

It has been discovered that the problem of contamination of the electron accelerating structures in a photomultiplier can be overcome by applying, after the formation of all or part of the photocathode, a coating to the electron accelerating structures, and primarily the first dynode of the photomultiplier, the coating comprising at least one layer of a secondary electron emissive material which has a secondary electron emission coefficient greater than or equal to one (i.e. at least one secondary electron is emitted for each primary electron incident on the material at the normal range of accelerating voltage for the device) and where the material has a low quantum efficiency, for example, less than $10^{-3}$ percent at a wavelength of 400 nanometers or greater.

Materials which have these desired characteristics are insulators or semiconductors having a large bandgap (i.e. 3 electron-volts or greater). In particular, it has been discovered that the alkali halides exhibit these desirable characteristics. Examples of such alkali halides are cesium iodide, cesium bromide, cesium chloride, potassium bromide, potassium chloride, potassium iodide, lithium fluoride, sodium bromide, sodium chloride, sodium fluoride, sodium iodide, rubidium chloride and rubidium bromide. These materials are relatively good secondary electron emitters and have low quantum efficiencies (i.e. less than $10^{-3}$ percent) at wavelengths of 400 nanometers or greater.

In addition to being relatively good secondary electron emitters and being relatively insensitive to photons at wavelengths greater than 400 nanometers, the alkali halide material may be applied to the dynodes or other electron accelerating structures of the photomultiplier by a directional, evaporative process, rather than by gaseous diffusion. In this manner the application of the alkali halide can be controlled to prevent deposition of this material on areas where it is unwanted, e.g. on the photocathode.

Although the exact means by which the free alkali metal is passivated is not clear, it is believed that the alkali halide material applied to the dynodes or other electron accelerating structures serves to simply coat the free alkali metal, although there is the possibility that the alkali halide material may react to some extent with these free alkali metals.

In one embodiment of the invention the alkali halide selected for deposition on the electron accelerating structure has a larger lattice constant than the alkali halide formed from the free alkali used in the formation of the photocathode, thus allowing the free alkali to move easily into the lattice and be trapped. For example, cesium bromide could be used as the alkali halide where a rubidium telluride ($Rb_2Te$) or potassium telluride ($K_2Te$) cathode is used. Alternatively, the alkali halide is selected to be a halide of an alkali metal which is as electronegative or more electronegative than the alkali metal applied to the photocathode.

In another embodiment of the invention, the alkali halide which is selected for deposition on the electron accelerating structures corresponds to the alkali halide of an alkali metal used as one component of the photocathode. For example, if cesium is one component of the photocathode, cesium iodide is used as the dynode coating material.

The present invention also encompasses a method of applying the coating material to the dynode, and in particular a method whereby the dynode coating material is applied by thermal evaporation subsequent to the deposition of the photocathode material.

BRIEF DESCRIPTION OF THE DRAWING FIGURES

These and other features and advantages of the present invention will now be described with reference to the following detailed description of the preferred embodiments and as shown in the accompanying drawing figures wherein:

FIG. 1 is a partial cross-sectional view of one type of photomultiplier structure the present invention may be used with;

DETAILED DESCRIPTION OF THE PREFERRED EMBODIMENTS

Figure 1:
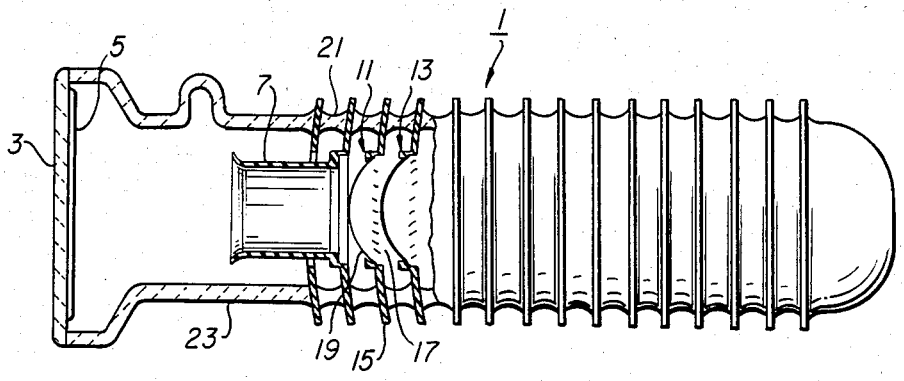

FIG. 1 shows one type of well-known photomultiplier structure with which the coating materials and processes of the present invention may be used. It will be understood that the structure shown in FIG. 1 and hereinafter described is merely illustrative and that the materials and techniques of the present invention are equally applicable to other well-known types of photomultiplier structures, including those of the microchannel plate type.

Photomultiplier 1 comprises a faceplate or window 3 formed from a material which is relatively transparent to the wavelengths of radiation of interest. For ultraviolet applications, the faceplate window can be formed from materials such as lithium fluoride, magnesium fluoride, barium fluoride, sapphire and certain UV-transmissive types of glass. A photocathode material 5 is disposed on the interior face of window 3. Photocathode 5 may be formed from any variety of UV-sensitive materials, such as rubidium telluride, cesium telluride, cesium iodide or rubidium iodide. Cesium telluride and ribidium telluride are particularly useful as they exhibit good quantum efficiency in the ultraviolet and are readily applied using an evaporative process for the tellurium and a gaseous diffusion process for the rubidium or cesium. The photocathode formation process is described in more detail below.

At least one annular focusing electrode 7 is provided along the longitudinal axis of the photomultiplier and spaced apart from window 3. Also shown are first and second dynode stages 11 and 13 which are similar in construction and include an annular electrode 15 for connection to a source of DC potential, a dynode 17 (here illustrated as being of the venetian-blind type) and a mesh screen or grid 19. Electrode 15, dynode 17 and grid 19 are normally all electrically connected together so as to be at the same electrical potential. There are generally further dynode stages similar in construction to dynode stages 11 and 13 but they have been omitted from FIG. 1 for clarity.

Not shown in FIG. 1 is a disk-like collecting anode which is disposed at the opposite end of the photomultiplier 1 from window 3 and serves to collect the electrons emitted by the final dynode stage.

As shown in FIG. 1, each succeeding dynode stage is separated from its neighbor by means of a series of glass rings or spacers 21. Window 3 is separated from focusing electrode 7 and the dynode structure by means of annular glass spacer 23.

In operation, photons of radiation to which photocathode material 5 is sensitive (e.g. ultraviolet radiation), are absorbed by the photocathode material and cause photoelectrons to be ejected from the rear surface of the photocathode material. If a DC potential is applied between photocathode 5 and each of the electron accelerating structures (focusing electrode 7 and dynode stages 11 and 13 etc.) and the potential applied to each succeeding electron accelerating structure is made more positive than the preceeding (e.g. dynode stage 13 is made more positive than dynode stage 11) the effect is to cause any photoelectrons ejected by photocathode material 5 to be accelerated to first dynode stage 11 where they strike dynode 17. The surface of dynode 17 is coated with a material exhibiting good secondary electron emission characteristics, such as beryllium oxide. The impact of a primary photoelectron causes one or more secondary electrons to be emitted from the surface of the dynode. The secondary electrons are then attracted to the next dynode stage (which has a more positive potential applied to it), with the process continuing for each succeeding dynode stage until the electrons are collected at the anode. In this fashion, depending on the number of dynode stages utilized, gains of several thousand or million times are possible.

It should be noted that grid 19 of a dynode stage serves to improve collection of the secondary electrons emitted from dynode 17 by allowing them to travel a short distance from the dynode. This is because grid 19 is at the same potential as dynode 17. Grid 19 is a very fine mesh and thus does not interfere to any great extent with the travel of primary electrons which are being accelerated toward the dynode.

As stated earlier, one problem associated with so-called "solar blind" photomultipliers is that the materials and processing techniques for applying the photocathode material 5 to window 3 causes unwanted contamination of the surfaces of the electron accelerating structures (e.g. focusing electrode 7 and dynode stages 11, 13 etc.) with the alkali metals used in forming the photocathode. This contamination causes these electron accelerating structures to be photoemissive at undesirable wavelengths (e.g. at wavelengths greater than 350–400 nanometers or so).

In order to explain how this problem arises it will be necessary to briefly describe one common process for forming the photocathode.

By way of illustration, cesium telluride may be used to form a photocathode which is sensitive to ultraviolet radiation. The formation of a cesium telluride photocathode is well known and is discussed in A. H. Sommer, *Photoemissive Materials,* Robt. E. Krieger, Publisher, New York, 1980, pages 179–182 and by E. Taft and L. Apker, *Photoemission from Cesium and Rubidium Tellurides,* Journal of the Optical Society of America, Volume 43, No. 2, February 1953, pages 81–83, and the references cited therein.

Figure 2:
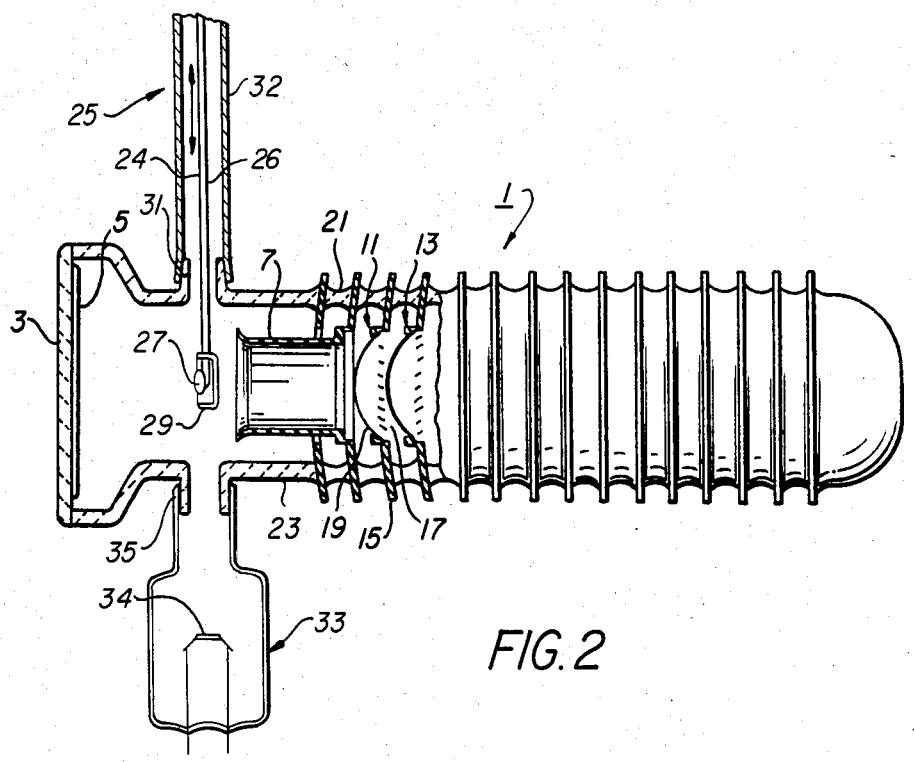
FIG. 2 illustrates the process of photocathode deposition on the photomultiplier of FIG. 1.

For such a photocathode the process is typically as follows:

A thin layer of metal or other conductive undercoating is applied to the inside surface of window 3 by means of an evaporator unit 25, as shown in FIG. 2. Evaporator unit 25 comprises a pair of electrically conductive wires 24 and 26 having disposed at their free ends a small bead 27 of metal. Bead 27 is partially surrounded by a protective shield or so-called "boat" 29 formed from a refractory material.

Evaporator unit 25 is inserted through an opening or so-called "tubulation" 31 formed in the wall of photomultiplier 1. Although not shown in detail, evaporator unit 25 is disposed within a manifold and is surrounded by an envelope 32 connected to tubulation 31 which is under vacuum (approximately $10^{-8}$ torr) during the processing of the photocathode.

An alkali metal generator unit 33 is connected to photomultiplier 1 via a second tubulation 35 as shown in FIG. 2. Unit 33 includes, for example, a filament 34 formed from a alkali metal, such as cesium, to which an electrical current may be applied.

Evaporator unit 25 is inserted through tubulation 31 so that bead 27 is disposed approximately along the longitudinal axis of photomultiplier 1 and with the open end of boat 29 facing window 3. Approximately 6 to 8 amperes of current is applied to the wires of evaporator unit 25 to bring the temperature of the metal bead to approximately its melting point where it is maintained for about 15 to 30 seconds. The metal evaporates from the surface of the bead and is deposited on the inside surface of window 3. This type of evaporation is directional (i.e. approximately perpendicular to the surface of bead 27). Boat 29 prevents evaporated metal from traveling toward unwanted areas such as dynode 17.

The conductive metal coating is applied until the transmissivity of white light through window 3 drops by a certain percent, typically 10%–20%. The conductive coating acts as an electrode during subsequent processing steps since the primary photocathode materials are relatively poor electrical conductors.

The photocathode material is next applied. Prior to the photocathode deposition process, the temperature of the window area of the photomultiplier is brought up to approximately 100° C., and the vacuum on the system (photomultiplier, evaporator unit and alkali metal generator unit) is maintained at approximately $10^{-8}$ torr.

Approximately 5 to 6 amperes of current are applied to the cesium filament 34 of generator unit 33 to bring the cesium to its boiling point to add this alkali metal to the photomultiplier. After a period of time (approximately 15 to 20 minutes) the cesium gas diffuses into the photomultiplier and begins deposition on the photocathode area 5. The application of cesium continues until the response of the photomultiplier to ultraviolet light reaches a peak. The photo-response of the tube is measured by applying a DC potential (approximately 150 volts) between the conductive metal electrode forming part of photocathode 5 and the focusing electrode 7, with the photocathode being made negative with respect to the focusing electrode and measuring the resultant current between the electrode and photocathodes. The current between the photocathode and focusing electrode is caused by photoelectrons ejected from the coatings on window 3 collecting on electrode 7.

A second evaporator, similar in structure to evaporator unit 25, but bearing a bead of tellurium, is inserted through tubulation 31 into the interior of photomultiplier 1. A current of two to three amperes is applied to the evaporator unit to bring the tellurium bead up to near its melting point of approximately 452° C. and thus cause the vapor pressure of the material to increase to the point where evaporation begins. The protective boat 29 of the tellurium evaporator unit is oriented so that tellurium evaporated off the bead is directed toward window 3. Tellurium is evaporated until the photo-response (in UV light) of the photocathode drops approximately 50% from its peak (nominally 40–60% of its peak).

The cesium generator unit is turned on again and the photo-response of the photomultiplexer generally rises to a new peak which is above the previous peak. The cesium generator unit is then turned off and the tellurium evaporator unit is turned on until the measured photo-response of the photomultiplier drops to 50% of the just preceding peak. This process is then continued until the new cesium peak does not exceed the old cesium peak. Generally, it takes a total of from 9–16 layers of cesium and tellurium to complete the photocathode.

The foregoing process insures that the resultant composition of the photocathode is approximately stoichiometric, i.e. almost all of the cesium and tellurium present on the photocathode combines to form cesium telluride ($Cs_2Te$).

Subsequent to the processing of the photocathode, tubulation 35 is pinched off and sealed and cesium generator unit 33 is removed. The photomultiplier is then heated to approximately 120°–125° C. and maintained at this temperature for about 30 minutes to bake out any contaminants present in the photomultiplier. After bakeout, the tube is allowed to cool to room temperature.

It has been found that the foregoing photocathode formation process apparently deposits some quantities of the alkali metal component used in forming the photocathode (e.g. cesium) on surfaces of the photomultiplier other than the photocathode area. In particular, the alkali metal component is deposited upon the electron accelerating structures, such as the focusing electrode and the dynodes. This is due to the gaseous diffusion process by which alkali metals, such as cesium, are applied during photocathode processing. Unfortunately, these alkali metals are good photoelectron emitters at undesirable wavelengths, i.e. at wavelengths greater than 350–400 nanometers. Since these photocathode materials are also semi-transparent, any such alkali metal contamination on the electron accelerating structures can cause a substantial photo-response (photosensitivity) at undesirable wavelengths.

A primary feature of the present invention is the application of an alkali halide coating to the electron accelerating structures which acts to coat and/or passivate the photoemissive properties of any free alkali metal present on these structures while advantageously also exhibiting good secondary electron emission.

This process of coating the electron accelerating structures will now be described by way of example with respect to the use of cesium iodide (CsI) as one exemplary coating material. However, it will be understood that other alkali halides which exhibit good secondary electron emission coefficients and which have relatively low quantum efficiencies can be used as the coating material. For example, cesium bromide, cesium chloride, rubidium bromide, rubidium chloride, potassium bromide, potassium chloride, potassium iodide, lithium fluoride, sodium bromide, sodium chloride, sodium fluoride, and sodium iodide are all believed to be useful as coating materials within the scope of the present invention. Such alkali halides exhibit a secondary electron emission coefficient greater than or equal to one and a low quantum efficiency (i.e. less than $10^{-3}$ percent) at a wavelength of 400 nanometers or greater. In particular, cesium iodide, cesium chloride, rubidium chloride and rubidium bromide have been found to work particularly well to suppress photoemission at wavelengths of 350–400 nanometers or greater.

Since the primary problem of photosensitivity due to the presence of free alkali metals occurs on the surface of the dynodes, the following description of the coating process will be made with respect to coating of the first dynode 17 of the photomultiplier 1. This dynode is the most sensitive to free alkali metal contamination because it is oriented such that any radiation entering the tube through window 3 will strike the surface of the dynode.

One type of standard dynode is formed from a beryllium copper material, such as copper alloyed with approximately 2% beryllium. The beryllium copper dynode normally has a surface coating of a material exhibiting good secondary electron emission characteristics, such as beryllium oxide (BeO). It is believed that the free metal alkali component of the photocathode is deposited upon this beryllium oxide surface and causes the unwanted photosensitivity to wavelengths greater than 350–400 nanometers.

Figure 3:
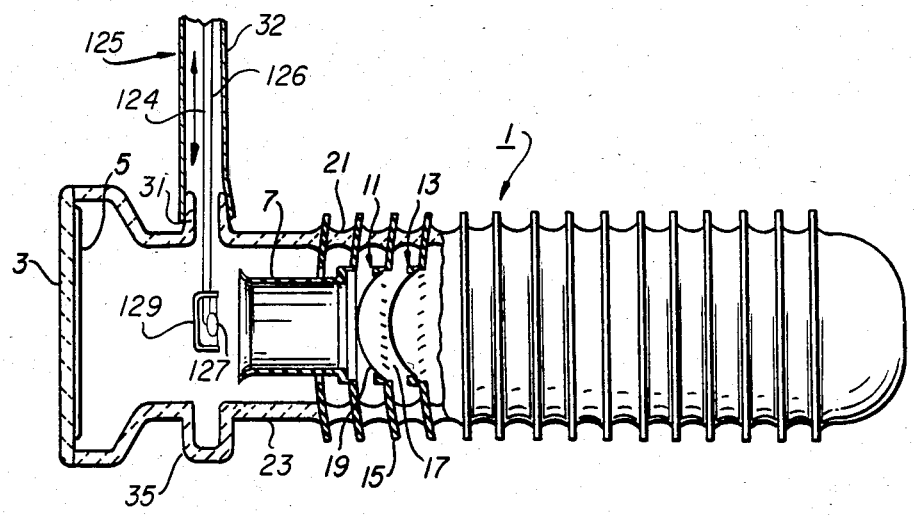
FIG. 3 shows the photomultiplier of FIG. 1 during the dynode coating process.

Dynode processing begins by applying a DC potential (approximately 150 volts) between first dynode stage 11 and focusing electrode 7, with the dynode being made negative with respect to the focusing electrode. A cesium iodide evaporator 125, similar in structure to the tellurium evaporator described above, is inserted into the photomultiplier through the remaining tubulation 31 as shown in FIG. 3. However, this evaporator is different from the tellurium evaporator in that its shield or "boat" 129 is oriented so that the cesium iodide is directed toward dynode 17.

Two to three amperes of current are applied to the evaporator unit to raise the temperature of the cesium iodide bead 127 to near its melting point and thus raise the vapor pressure of the bead high enough to begin evaporation. A 100 watt light bulb (not shown) is focused down from about 50 centimeters above the window 3 of the photomultiplier and onto the dynode 17 and is used to measure the dynode photo-response, i.e. the current between first dynode stage 11 and focusing electrode 7 due to photoelectron emission from the surface of dynode 17.

Prior to the deposition of cesium iodide, the dynode photo-response is generally in the range of 1 to $5\times10^{-10}$ amperes. As cesium iodide evaporates onto dynode 17, the photo-response drops until it reaches 1 to $2\times10^{-12}$ amperes or less. This generally takes from 1.5 to 3 minutes. When the photo-response drops below $1\times10^{-12}$ amperes or so the deposition is stopped and the dynode treatment is complete. During dynode processing the photomultiplier tube remains at room temperature and the internal pressure of the photomultiplier is maintained as closely as possible to $10^{-8}$ torr.

The cesium iodide evaporator is then withdrawn from the photomultiplier and tubulation 31 is then pinched off (while maintaining vacuum within photomultiplier 1) to complete the processing of the photomultiplier.

Figure 4:
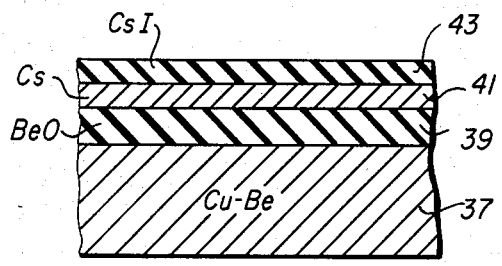
FIG. 4 is a cross-sectional view (not to scale) of a portion of a dynode of the photomultiplier shown in FIGS. 1-3.

FIG. 4 illustrates what is believed to be the resulting structure of the surface of dynode 17 after photocathode processing and completion of the dynode coating treatment. The dynode comprises a substrate or underlying layer of beryllium copper 37, upon which there is disposed a layer of beryllium oxide 39. Atop the beryllium oxide layer is a layer of the free alkali metal, such as cesium, which has been undesirably deposited there during the photocathode deposition process. Finally, atop the alkali metal layer 41 there is disposed a layer 43 of the alkali halide dynode coating material, such as the aforementioned cesium iodide.

As mentioned earlier, it is not presently known whether alkali halide layer 43 merely acts to coat the free alkali metal which contaminates the surface of the dynode, and thus suppresses photoemission due to radiation entering through window 3, or if alkali halide layer 43 actually reacts with free alkali metal layer 41 so as to chemically bind up (passivate) some or all of the free alkali metal. It is also believed that the alkali metal component of the alkali halide chosen for use as the coating material should be as electronegative or more electronegative than the alkali metal used as one component of the photocathode.

Figure 5:
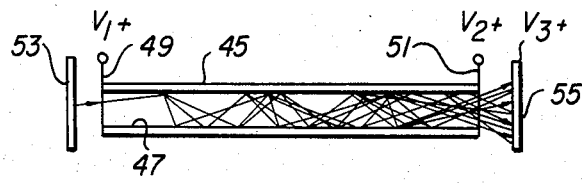
FIG. 5 is a cross-sectional view of a photomultiplier of the continuous channel type.

It will be appreciated that the materials and techniques described above with respect to a photomultplier having discrete dynodes may also be readily applied to other types of photomultiplier structures, such as those of the continuous channel type. As shown in FIG. 5, a continuous channel photomultiplier comprises a tubular, continuous dynode or channel 45 formed from a material such as glass whose interior surface 47 has been doped with a material exhibiting good secondary electron emission and electron conductivity, such as lead oxide which has been reduced in hydrogen gas. The front and rear surfaces of channel 45 are coated with an electrically conductive material to form electrodes 49 and 51 and a DC potential is applied to the electrodes, with the DC potential applied to exit electrode 51 being more positive than the potential applied to entrance electrode 49.

In operation, a photoelectron emitted from photocathode 53 is accelerated toward the entrance of channel 45 due to the positive DC potential applied to electrode 49. The photoelectron strikes the doped interior 47 of channel 45 and causes one or more secondary electrons to be emitted. These secondary electrons are accelerated toward the exit of channel 45 under the influence of the higher positive DC potential applied to exit electrode 51. These secondary electrons strike further portions of the interior of channel 45 causing a cascade of such secondary electrons. These secondary electrons are collected at anode 55 which is made more positive than the exit electrode. One or more such channel multiplier structures may be bundled together in parallel to form a microchannel plate photomultiplier device.

It will be appreciated that the presence of free alkai metal on the interior 47 of channel 45, due to the application of an alkali metal as a component of the photocathode, can cause unwanted photoemissivity within the channel. Such unwanted response can be reduced or eliminated by applying a coating of an alkali halide material, as described above, to the interior of the channel in a fashion similar to that described with respect to FIGS. 1–3.

Figure 6:
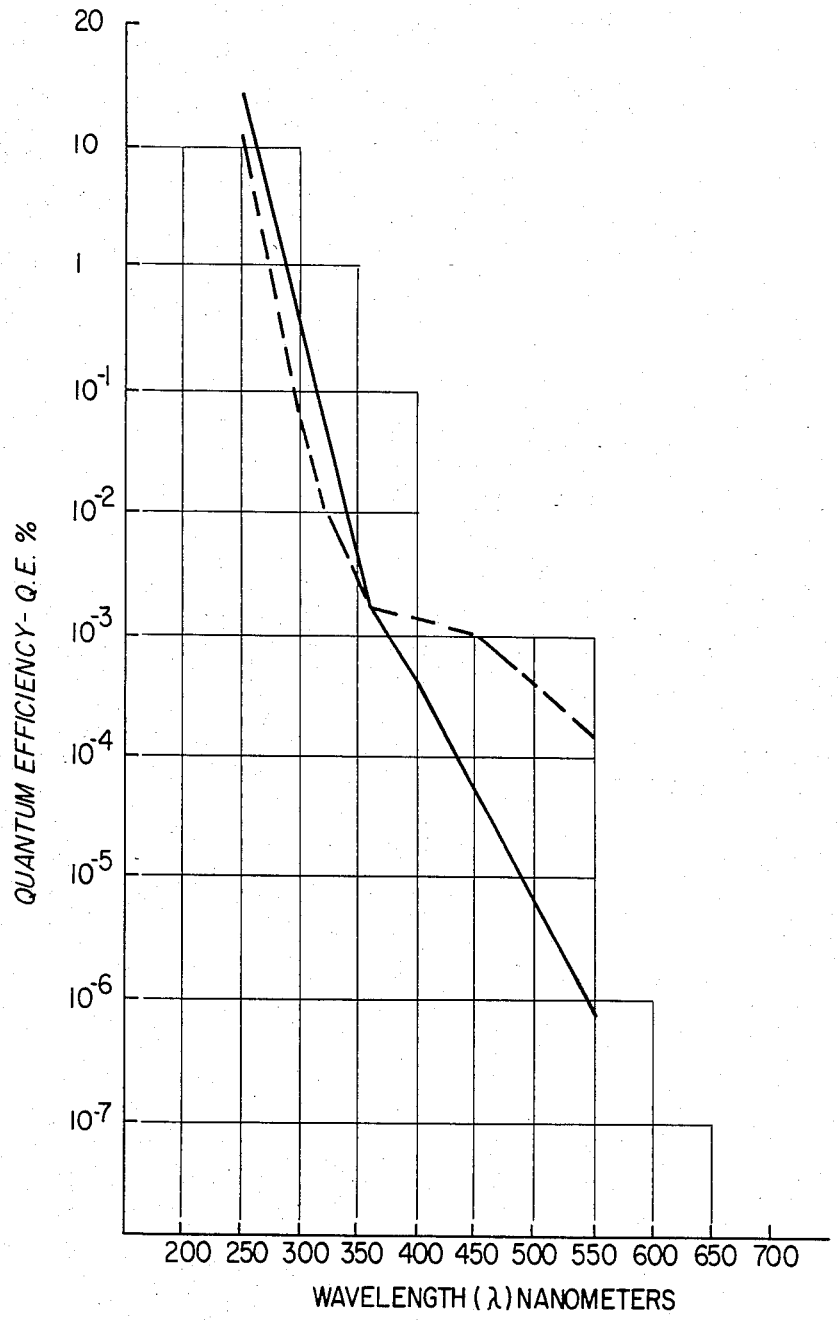
FIG. 6 is a graph of the quantum efficiency of a photomultiplier having uncoated dynodes (dashed line) and dynodes coated in accordance with the present invention (solid line) plotted as a function of the wavelength of incident radiation.

A comparison of photomultipliers of the type shown in FIGS. 1–3 having dynodes coated in accordance with the principles of the present invention and photomultipliers having untreated dynodes is shown in FIG. 6. The solid line represents the average response of a group of 8 photomultipliers having dynodes treated in accordance with the principles of the present invention, while the dashed line represents the average response of a group of 18 photomultipliers having the same construction and processing, but having untreated dynodes. The graph shows the percentage of quantum efficiency of the photomultipliers as a function of wavelength. It is readily apparent from FIG. 6 that at wavelengths greater than approximately 350–400 nanometers the sensitivity of photomultipliers treated in accordance with the principles of the present invention is greatly reduced (approximately 100 times at 550 nanometers) compared to similar photomultipliers without such treatment.

The foregoing dynode treatment also has been found to not adversely effect the gain characteristics of the photomultiplier, i.e. the secondary electron emission characteristics are substantially similar to those of an untreated dynode.

While the present invention has been described in considerable detail, it will be appreciated that various changes and modifications will be obvious to those skilled in the art. Accordingly, the foregoing is intended to be illustrative, but not limitive of the invention which is defined by the appended claims.

What is claimed is:

1. In a photomultiplier of the type including a photocathode formed from at least an alkali metal or compound thereof and at least one electron accelerating structure, such as a dynode or the like, an improved coating for said electron accelerating structure comprising:

at least one layer of a secondary electron emissive material disposed over the electron accelerating structure, the secondary electron emissive material being an alkali halide selected from the group consisting of cesium iodide, cesium bromide, cesium chloride, rubidium bromide, rubidium chloride, potassium bromide, potassium chloride, potassium iodide, lithium fluoride, sodium bromide, sodium chloride, sodium fluoride, and sodium iodide, the coating material coating any free alkali metal present on the surface of the electron accelerating structure whereby the photosensitivity of the electron accelerating structure to radiation of wavelengths of 400 nanometers or greater is reduced.

2. The photomultiplier of claim 1 wherein the alkali halide is selected from the group consisting of cesium iodide, cesium chloride, rubidium chloride and rubidium bromide.

3. The photomultiplier of claim 1 wherein the alkali halide selected is a halide of an alkali metal which is as electronegative or more electronegative than the alkali metal applied to the photocathode.

4. The photomultiplier of claim 3 wherein the alkali halide selected is a halide of the alkali metal applied to the photocathode.

5. The photomultiplier of claim 1 wherein the electron accelerating structure includes a plurality of discrete dynodes.

6. The photomultiplier of claim 1 wherein the electron accelerating structure is of the continuous channel type.

7. The photomultiplier of claim 1 wherein the electron accelerating structure includes a substrate formed from a conductive metal or alloys thereof.

8. The photomultiplier of claim 7 wherein the conductive metal is beryllium copper.

9. The photomultiplier of claim 1 wherein the surface of the electron accelerating structure has a layer of beryllium oxide formed thereon, over which the secondary electron emissive material is applied.

10. In a photomultiplier of the type including a photocathode having an alkali metal as a component thereof and at least one electron accelerating structure, such as a dynode or the like, an improved coating for the electron accelerating structure, comprising:

at least one layer of a coating material selected from the group consisting of cesium iodide, cesium chloride, rubidium chloride, and rubidium bromide formed over the electron accelerating structure, the coating material acting to coat free alkali metal present on the electron accelerating structure which is deposited during the process of forming the photocathode, whereby the photosensitivity of the electron accelerating structure to radiation of wavelengths of 400 nanometers or greater is reduced.

11. In a photomultiplier of the type including a photocathode formed from a photoemissive material and at least one electron accelerating structure, such as a dynode or the like, a method of coating the electron accelerating structure comprising the steps of: (a) applying at least one alkali metal or compound thereof to the photocathode; and (b) applying at least one layer of a secondary electron emissive material over the electron accelerating structure, wherein the secondary electron emission material is an alkali halide, the coating material coating any free alkali metal present on the surface of the electron accelerating structure due to the application of said alkali metal during step (a), whereby the photosensitivity of the electron accelerating structure to radiation of wavelengths of 400 nanometers or greater is reduced.

12. The method of claim 11 wherein the alkali halide is selected from the group consisting of cesium iodide, cesium bromide, cesium chloride, rubidium bromide, rubidium chloride, potassium bromide, potassium chloride, potassium iodide, lithium fluoride, sodium bromide, sodium chloride, sodium fluoride and sodium iodide.

13. The method of claim 11 wherein the alkali halide is selected from the group consisting of cesium iodide, cesium chloride and rubidium chloride and rubidium bromide.

14. The photomultiplier of claim 11 wherein the alkali halide selected is a halide of an alkali metal which is as electronegative or more electronegative as the alkali metal applied to the photocathode.

15. The method of claim 14 wherein the alkali halide selected is a halide of the alkali metal applied to the photocathode.

16. The method of claim 11 wherein the alkali metal is applied by gaseous diffusion.

17. The method of claim 11 wherein the alkali halide is applied by thermal evaporation.

18. In a photomultiplier of the type including a photocathode formed from a photoemissive material and at least one electron accelerating structure, such as a dynode or the like, a method of coating the electron accelerating structure comprising the steps of:

(a) applying at least one alkali metal to the photocathode by gaseous diffusion; and (b) applying a coating material selected from the group consisting of cesium iodide, cesium chloride, rubidium chloride and rubidium bromide to the electron accelerating structure, the coating material coating any free alkali metal present on the surface of the electron accelerating structure due to diffusion of said alkali metal during step (a), whereby the photosensitivity of the electron accelerating structure to radiation of wavelengths of 400 nanometers or greater is reduced.

* * * * *